US009756939B1

(12) United States Patent
Ruiz et al.

(10) Patent No.: US 9,756,939 B1
(45) Date of Patent: Sep. 12, 2017

(54) SHOE RACK

(71) Applicant: Whitmor, Inc., Southaven, MS (US)

(72) Inventors: Milton D. Ruiz, Germantown, TN (US); Sandy Felsenthal, Memphis, TN (US)

(73) Assignee: Whitmor, Inc., Southaven, MS (US)

( * ) Notice: Subject to any disclaimer, the term of this patent is extended or adjusted under 35 U.S.C. 154(b) by 0 days.

(21) Appl. No.: 15/259,892

(22) Filed: Sep. 8, 2016

Related U.S. Application Data

(60) Provisional application No. 62/303,766, filed on Mar. 4, 2016.

(51) Int. Cl.

| | |
|---|---|
| ***A47B 61/00*** | (2006.01) |
| ***A47B 61/04*** | (2006.01) |
| ***A47F 7/08*** | (2006.01) |
| ***A47B 96/06*** | (2006.01) |
| ***A47B 55/00*** | (2006.01) |
| ***A47B 43/00*** | (2006.01) |

(52) U.S. Cl.
CPC ..... *A47B 61/04* (2013.01); *A47B 43/003* (2013.01); *A47B 55/00* (2013.01); *A47B 96/068* (2013.01); *A47F 7/08* (2013.01)

(58) Field of Classification Search
CPC ... A47F 47/08; A47F 7/08; A47F 5/01; A47B 43/003; A47B 96/16; A47B 61/04
See application file for complete search history.

(56) References Cited

U.S. PATENT DOCUMENTS 1,039,694 A * 10/1912 Burton ..... A47F 5/13 108/163
2,244,887 A * 6/1941 Manley ..... A47B 43/003 108/149
3,235,096 A * 2/1966 Hallock ..... A21B 3/00 211/149
5,617,959 A * 4/1997 Klein ..... A47B 61/04 211/34
5,636,751 A * 6/1997 Frank ..... A47B 61/04 211/163
6,126,021 A * 10/2000 Wilhite ..... A47B 43/04 211/113
6,464,086 B1 * 10/2002 Klein ..... A47B 96/16 211/35
6,637,609 B2 * 10/2003 Stevens ..... A47F 5/0892 108/149

(Continued)

*Primary Examiner* — Leslie A Nicholson, III
*Assistant Examiner* — Kimberley S Wright
(74) *Attorney, Agent, or Firm* — Stites & Harbison PLLC; Richard S. Myers, Jr.

(57) ABSTRACT

A storage unit for attachment to a door or similar structure is provided. The storage unit can be configured for holding shoes or any other suitably desired items. The storage unit can include a frame portion having two vertical supports and a plurality of horizontal cross supports extending perpendicularly from and between the two vertical supports. The storage unit can further include a liner portion constructed from fabric, plastic or other suitable material. The liner portion can be configured for connection to the frame portion and can include a plurality of shelving supports that can be attached to the plurality of horizontal cross supports in order to create a series of angled shelves along the height of the frame portion.

15 Claims, 8 Drawing Sheets

(56) References Cited

U.S. PATENT DOCUMENTS 6,786,337 B2 * 9/2004 Klein ..... A47F 7/08 211/134
6,877,614 B2 * 4/2005 Hu ..... A47B 45/00 211/34
7,097,048 B2 * 8/2006 Rimback ..... A47F 7/08 211/34
7,762,406 B2 * 7/2010 Qiang ..... A47B 61/04 211/118
7,938,279 B2 * 5/2011 Kaplan ..... A47B 43/003 108/47
D649,819 S * 12/2011 Malik ..... D6/513
8,636,156 B2 * 1/2014 Malik ..... A47B 57/04 211/106
D707,978 S * 7/2014 Ruiz ..... D6/320
2002/0162815 A1 * 11/2002 Wang ..... A47B 43/003 211/194
2002/0190017 A1 * 12/2002 Stevens ..... A47F 5/0892 211/118
2004/0035806 A1 * 2/2004 Klein ..... A47F 7/08 211/34
2004/0118791 A1 * 6/2004 Rimback ..... A47F 7/08 211/34
2004/0245192 A1 * 12/2004 Hu ..... A47B 45/00 211/34
2006/0076305 A1 * 4/2006 Wang ..... A47B 47/0075 211/113
2006/0254991 A1 * 11/2006 Klein ..... A47F 7/08 211/37
2007/0284321 A1 * 12/2007 Qiang ..... A47B 61/04 211/38
2009/0026161 A1 * 1/2009 Scriba ..... A47F 5/01 211/144
2010/0155350 A1 * 6/2010 Kaplan ..... A47B 43/003 211/113
2013/0220957 A1 * 8/2013 Malik ..... A47B 57/04 211/119.004
2014/0103000 A1 * 4/2014 Avissar ..... A47G 25/0614 211/85.3

* cited by examiner

SHOE RACK

CROSS-REFERENCE TO RELATED APPLICATIONS

This Application claims priority to U.S. Provisional Patent Application Ser. No. 62/303,766, filed on Mar. 4, 2016, to Milton D. Ruiz et al., entitled "Shoe Rack,", the entire disclosure of which is incorporated herein by reference.

FIELD OF THE INVENTION

The present invention relates to a storage unit, and in particular, a shoe storage unit configured for placement on a door, wall or similar structure.

BACKGROUND OF THE INVENTION

Door-mounted storage racks and units are generally known in the art, particularly storage racks for the storage of shoes and the like. However, currently known designs commonly fail to adequately secure the shoes or other items intended to be stored in the rack, resulting in such shoes or other items falling from the rack. This problem is especially persistent when such storage racks are hung from commonly used doors, where the movement of the door causes the shoes and other items to shift and potentially fall. These known designs include a frame constructed from metal or plastic with a series of horizontal cross-bars from which shoes or other items are placed. The cross-bars are arranged in a spaced apart manner and have void spaces or air gaps located therebetween. The result of this configuration is that shoes and other items can easily fall through the void spaces, the front or back of the rack, or from one side of the horizontal cross-bars. This can be especially problematic when shoes and other items of different dimensions are stored on the same rack or shelf. Accordingly, a need exists for a door-mounted shoe storage rack capable of retaining shoes in the rack and preventing shoes from falling out of the front, back or sides of each shelf.

SUMMARY OF THE INVENTION

The present invention is directed generally to a storage unit configured for attachment to a door, wall or similar generally vertical surface. The storage unit can include a frame portion and a liner portion and can include a plurality of shelving units. The shelving units can be configured with an angled orientation in order to assist in maintaining objects within the shelves.

The frame portion can include a pair of vertically-orientated supports and a plurality of horizontal cross supports spaced along the height of the vertical supports. The vertical supports can additionally include an inward curved or bent section that allows the storage unit to be positioned a desirable distance away from the door or other vertical mounting surface.

The liner portion can include a backer component configured for placement behind the frame and a plurality of shelving components generally corresponding to the horizontal cross supports of the frame. Each shelving component can have one end fixed to the backer component and another end configured for securement to one of the horizontal cross supports of the frame. In addition, each shelving component can be secured to the backer component at a height slightly below the height of a corresponding cross support of the frame so that shelving component is suspended with a slight angled orientation when the frame and liner portions are connected together.

Collectively, the frame portion and the liner portion form a plurality of angled shelves along the height of the storage unit. The backer component provides an enclosed rear portion of the storage unit so that shoes or other items are less likely to fall from the storage unit. The shelving components of the liner portion can also extend across the entire space between the horizontal cross supports of the frame and the backer component in order to prevent the shoes or other items stored in the storage unit from falling between the components of the frame.

Other aspects and advantages of the present invention will be apparent from the following detailed description of the preferred embodiments and the accompanying drawings figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
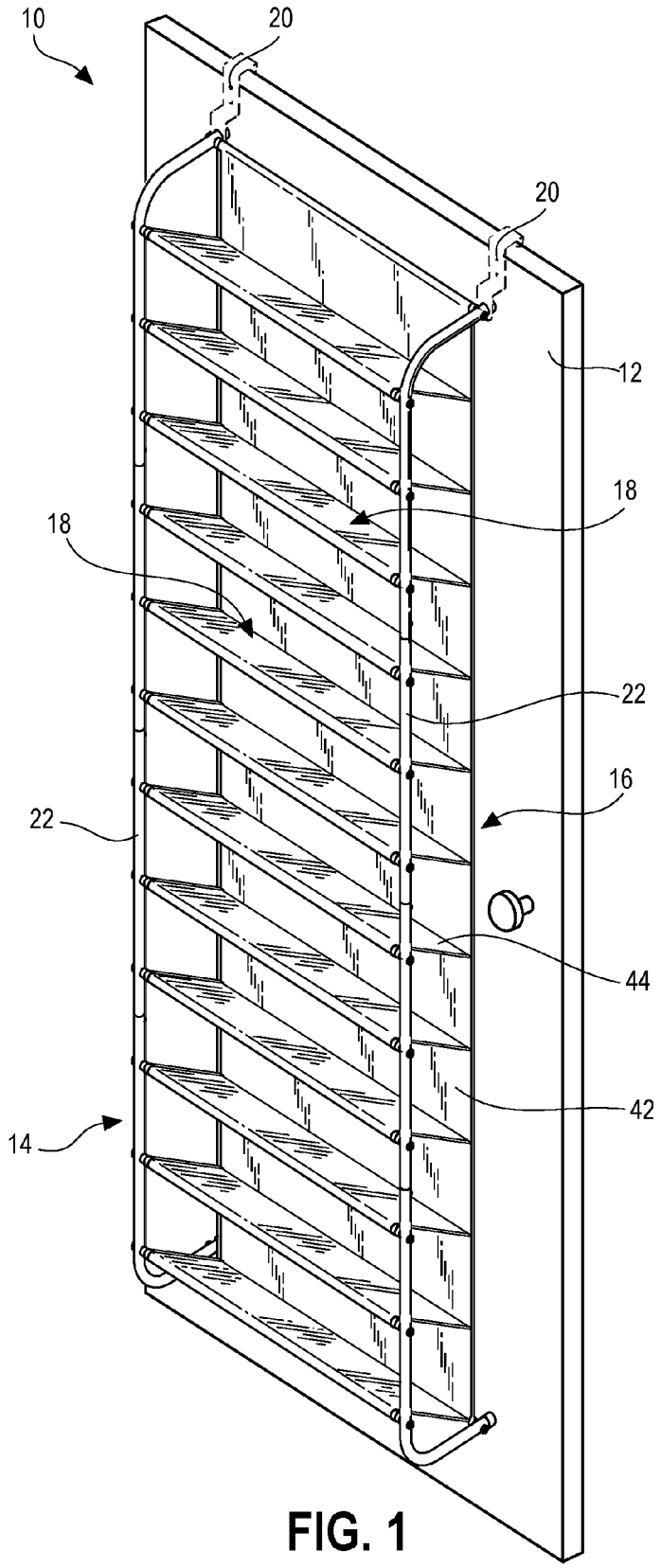
FIG. 1 is a perspective view of a door-hanging storage unit in accordance with one embodiment of the present invention.
Figure 2:
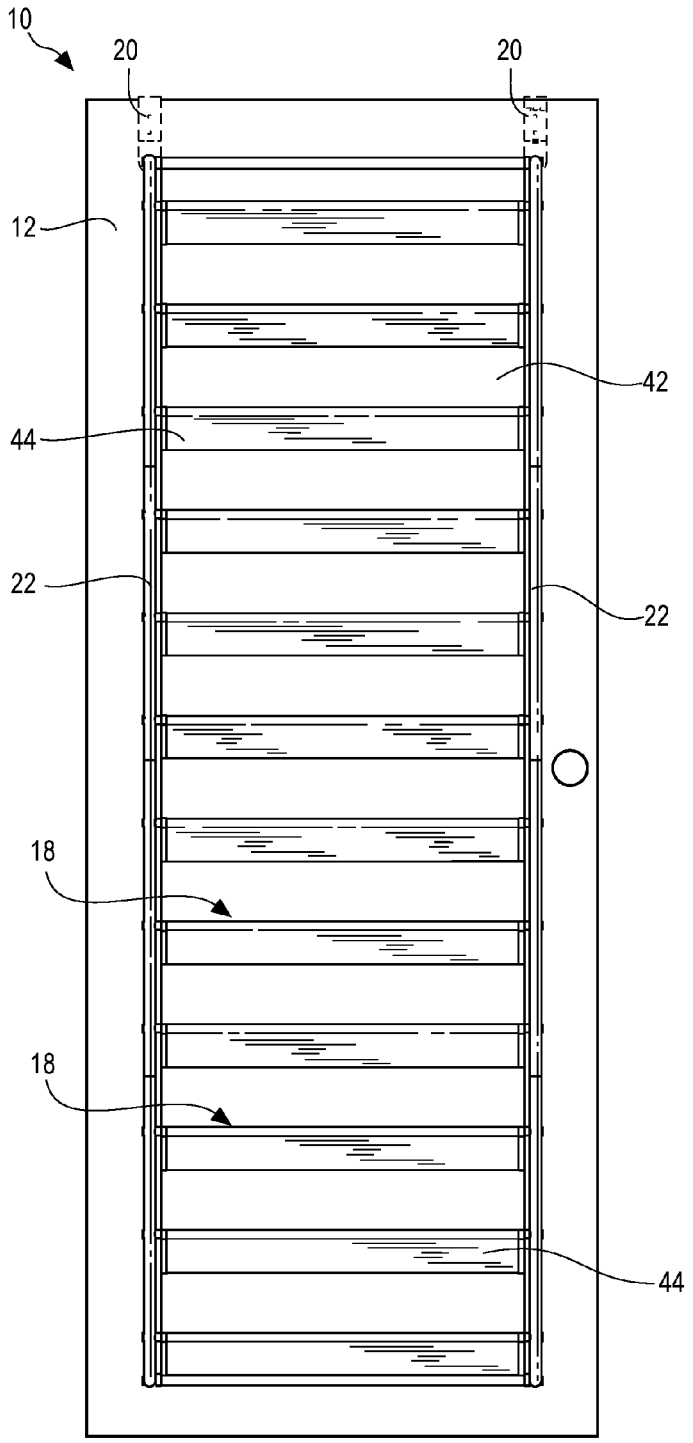
FIG. 2 is a front elevation view of the storage unit of FIG. 1.
Figure 3:
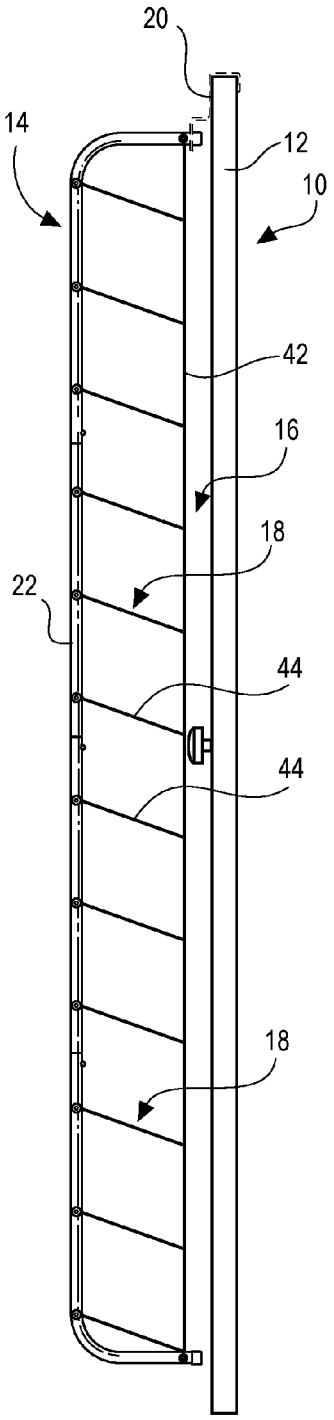
FIG. 3 is a side elevation view of the storage unit of FIG. 1.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed generally to a storage unit 10 that can be mounted to or otherwise hung from a door, wall or similar vertical structure 12 as illustrated in FIG. 1. Storage unit 10 as shown and described herein relates specifically to a storage unit for holding and storing shoes; however, it is recognized that storage unit 10 can be designed and configured to hold and store any number of different items depending on the particular embodiment of the present invention.

As shown in FIG. 1, storage unit 10 can comprise a frame portion 14 and a liner portion 16. Depending on the specific embodiment of the present invention, frame portion 14 and liner portion 16 can be integrally configured as a single component or frame portion 14 and liner portion 16 can be constructed separately and configured to be connected together. FIGS. 4-7 illustrate frame portion 14 apart from liner portion 16 and FIGS. 8-11 illustrate liner portion 16 apart from frame portion 14. FIGS. 1-3, and 12-13 illustrate frame portion 14 and liner portion 16 together forming storage unit 10. As also shown in FIG. 1, frame portion 14 and liner portion 16 can collectively form a plurality of shelves 18 along the height of storage unit 10. As shown, shelves 18 can have a slightly angled orientation as described in greater detail below. However, in alternative embodiments of the present invention, shelves 18 can have a generally flat orientation or an angled orientation of any desired degree.

Storage unit 10 can be configured for securement to structure 12 by any suitable means. According to the embodiment illustrated in FIGS. 1-3, storage unit 10 can include one or more mounting brackets 20 to secure storage unit 10 to a door 12. Mounting brackets 20 can be configured as any suitable type of bracket, hook, clip, fastener or other suitable connecting means in order to enable storage unit 10 to hang from, be mounted to, or otherwise be affixed to structure 12, such as a door or wall. Mounting brackets 20 can further be constructed from any suitable material, including metal or plastic, and can be connected to frame portion 14 at any desirable location.

Turning to FIGS. 4-7, frame portion 14 can comprise two generally parallel and generally vertical supports 22 and a plurality of generally horizontal cross supports 24 extending therebetween. Frame portion 14 can also be configured with more than two vertical supports 22 and additional cross supports 24 extending therebetween in certain alternative embodiments of the present invention (not shown). Both vertical supports 22 and horizontal cross supports 24 can be constructed from any suitable material, including metal or plastic, and can be in the form of solid or hollow tubes, bars or rods. It is also recognized that other design choices for vertical supports 22 and horizontal cross supports 24 can be utilized in alternative embodiments.

Figure 4:
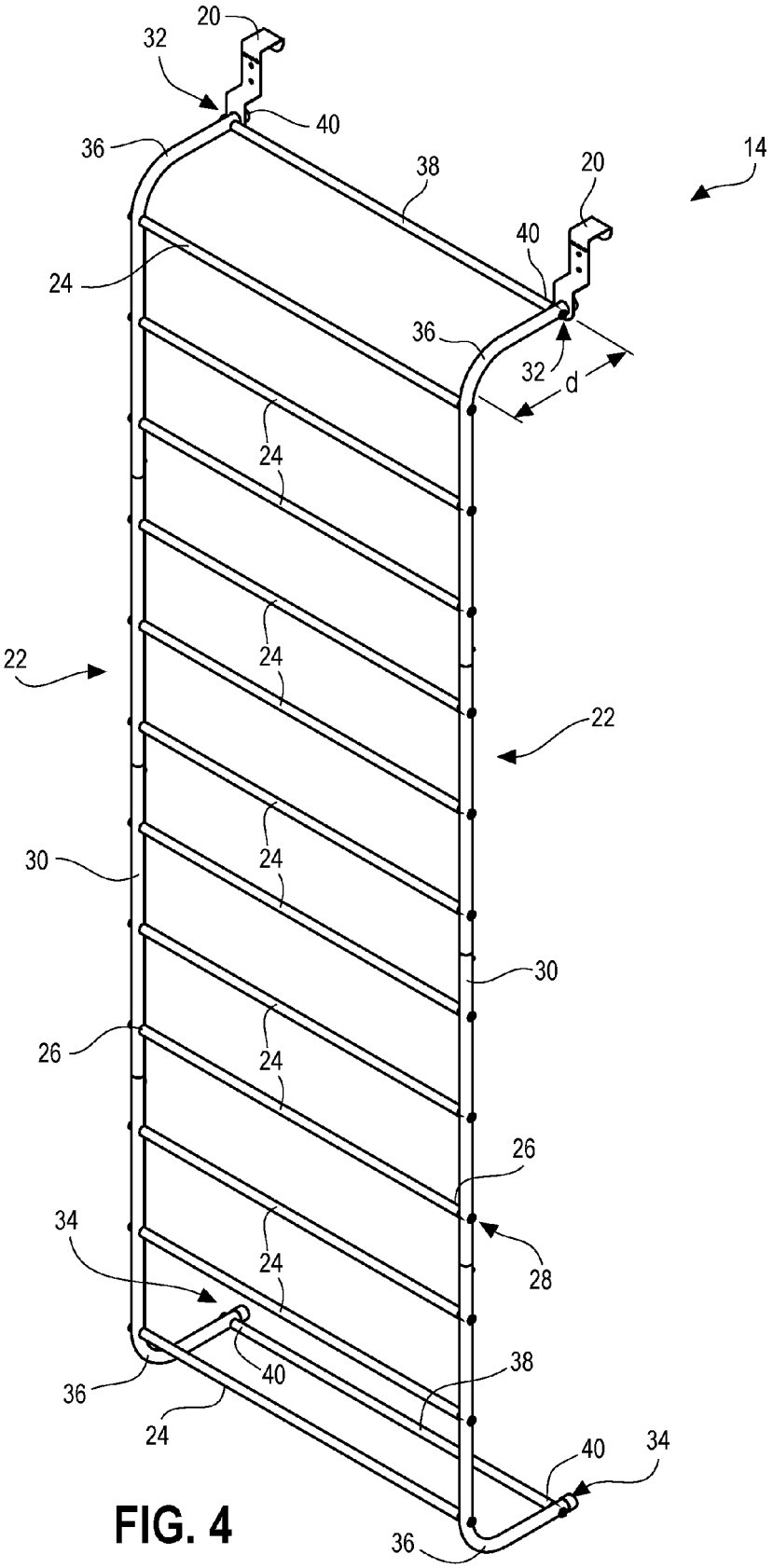
FIG. 4 is a perspective view of a frame portion of a storage unit in accordance with one embodiment of the present invention.
Figure 7:
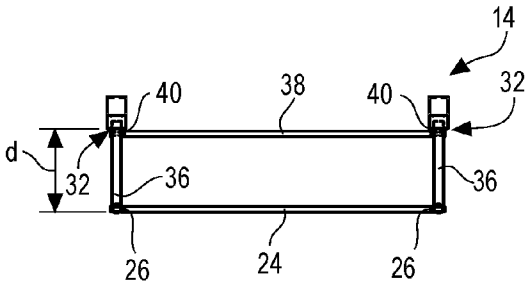
FIG. 7 is a top plan view of the frame portion of FIG. 4.
Figure 6:
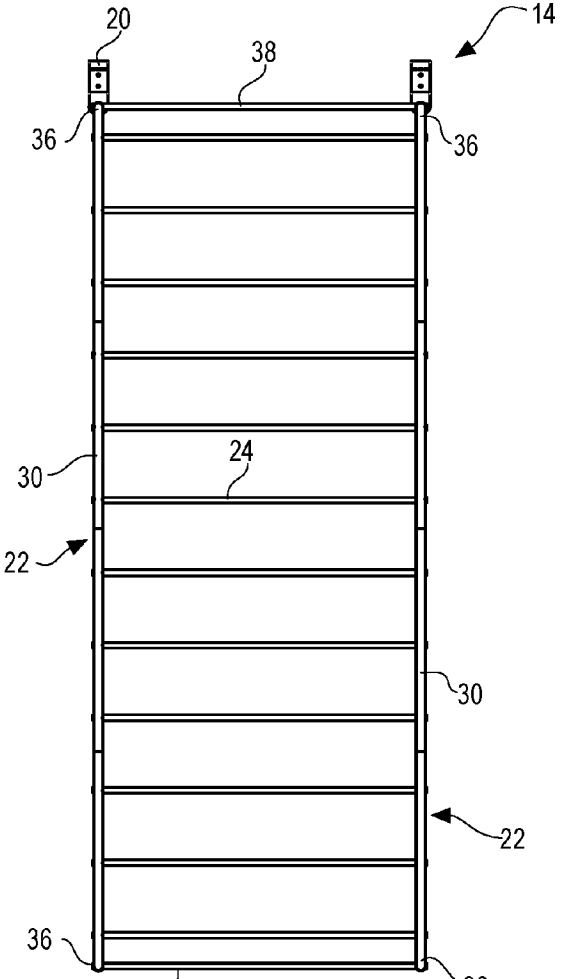
FIG. 6 is a front elevation view of the frame portion of FIG. 4.
Figure 5:
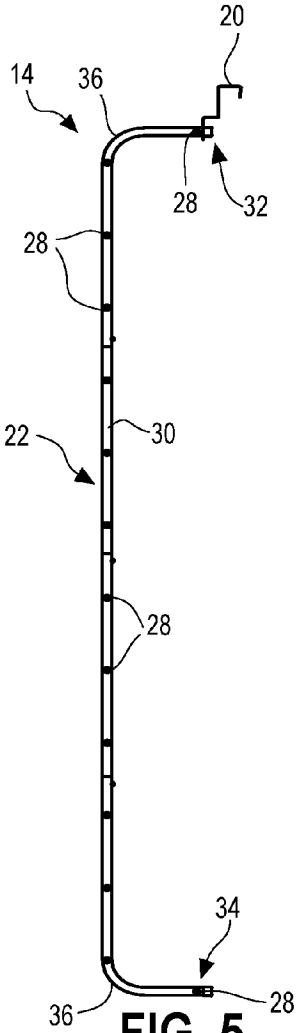
FIG. 5 is a side elevation view of the frame portion of FIG. 4.
Figure 14:
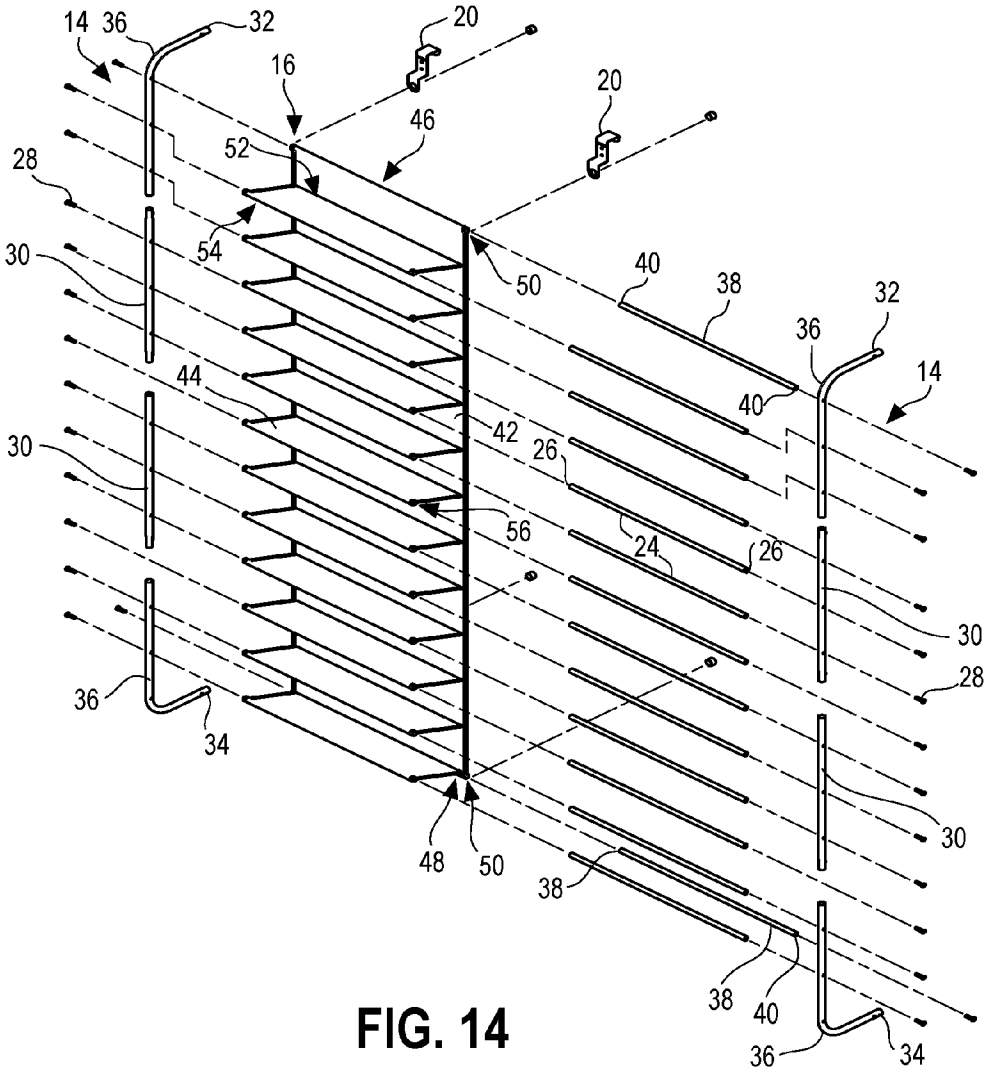
FIG. 14 is an exploded perspective view of a storage unit in accordance with one embodiment of the present invention.

Vertical supports 22 can be laterally spaced from each other in a generally parallel fashion and the plurality of horizontal cross supports 24 can be positioned in the space between the two vertical supports 22 along the height of frame portion 14. FIGS. 4-7 illustrate horizontal cross supports 24 equally spaced apart from one another along the height of frame portion 14; however, such equal spacing is not required and horizontal cross supports 24 can be variably spaced in certain embodiments of the present invention. As best shown in FIGS. 4 and 14, each horizontal cross support 24 can include a pair of ends 26 that can connect to the two vertical supports 22 by connecting means 28 in order to attach each horizontal cross support 24 to vertical supports 22. As best shown in FIGS. 4 and 5, each end 26 can be connected to the corresponding vertical support 22 so that cross support 24 is secured between the pair of vertical supports 22. Connecting means 28 can be any suitable type of connection, including screws, bolts, openings, slots, clips, fasteners and the like. Additionally connecting means 28 can comprise welding joints securing horizontal cross supports 24 to vertical supports 22.

Vertical supports 22 can be configured as generally elongated bars, rods or columns and, as best shown in FIG. 14, can be constructed from one or more sections. According to one embodiment of the present invention as best shown in FIG. 4, each vertical support 22 can include an elongated intermediate section 30 and inwardly-displaced upper and lower ends 32 and 34, respectively, which can be created by curved and/or horizontal shaped end sections 36. As best shown in FIG. 4, the curved and/or horizontal end sections 36 can create a depth "d" between intermediate sections 30 and ends 32 and 34. Depth d can allow for the formation of shelves 18 as described in greater detail below. The curved and/or horizontal shaped end sections 36 can also allow vertical support ends 32 and 34 to have a generally horizontal orientation relative to intermediate sections 30.

As further shown in FIGS. 4-7, frame portion 14 can include a generally horizontal end support 38 positioned between upper ends 32 and between lower ends 34 of vertical supports 22. Each horizontal end support 38 can include two ends 40 in order to secure the end support 38 to the upper or lower end 32 or 34 of vertical supports 22 in a manner similar to horizontal supports 24. Similar connecting means 24 can be also be used to secure end supports 38 so that they are secured to and between vertical supports 22. Horizontal end supports 38 can assist in maintaining the position of liner portion 16 relative to frame portion 14 when frame portion 14 and liner portion 16 are connected together as described in greater detail below.

Figure 12:
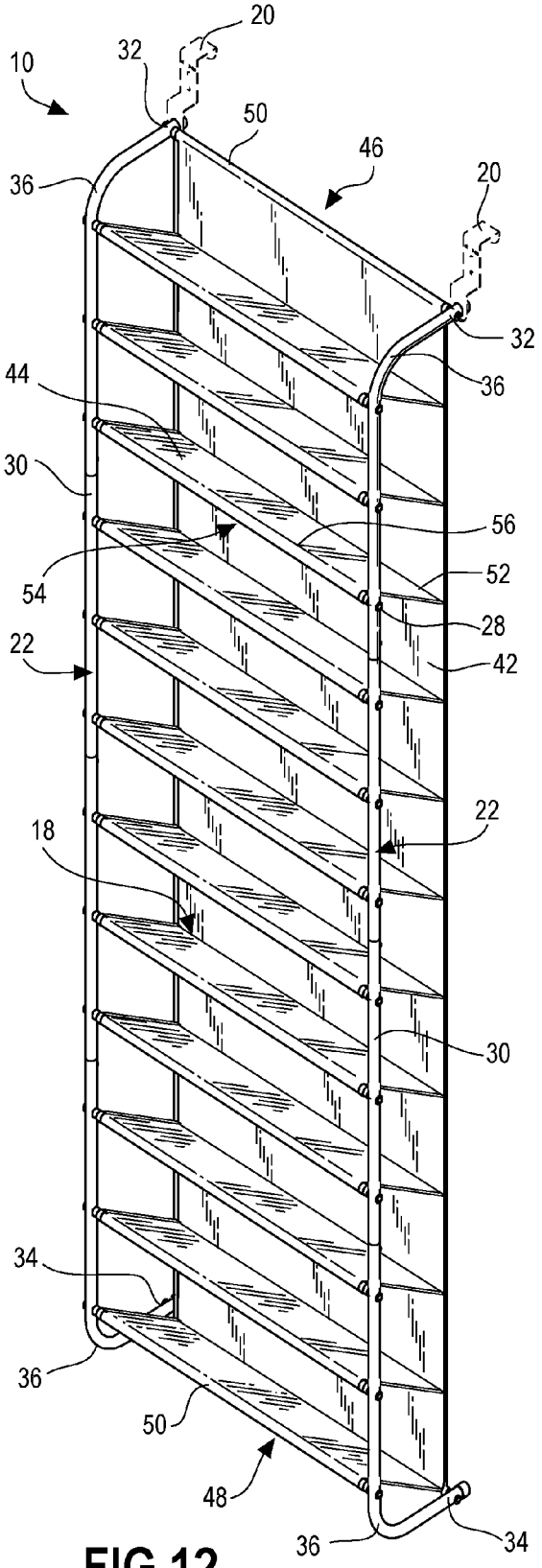
FIG. 12 is a perspective view of a storage unit having a frame portion and a liner portion in accordance with one embodiment of the present invention.

Turning now to FIGS. 8-11, liner portion 16 can be constructed from any suitable flexible or semi-rigid material, including fabric, plastic, mesh or other suitable material. Liner portion 16 can include a backer component 42 and a plurality of shelving components 44 spaced along the height of backer component 42. As best shown in FIG. 12, backer component 42 can be sized and shaped to generally conform to the shape of frame portion 14 and can be configured for placement behind vertical supports 22. In such an embodiment, backer component 42 spans laterally between vertical supports 22 along the entire height of frame portion 14. In alternative embodiments (not shown), backer component 42 can span only part of the height of frame portion 14 and/or only part of the space between vertical supports 22. As also best shown in FIGS. 12 and 13, backer component 42 can be positioned a distance away from intermediate sections 30 of vertical supports 22 approximately equal to depth d due to inward positioned ends 32 and 34 of vertical supports 22. This configuration creates a voided region between intermediate sections 30 and backer component 42 in order to create room for shelves 18.

Figure 8:
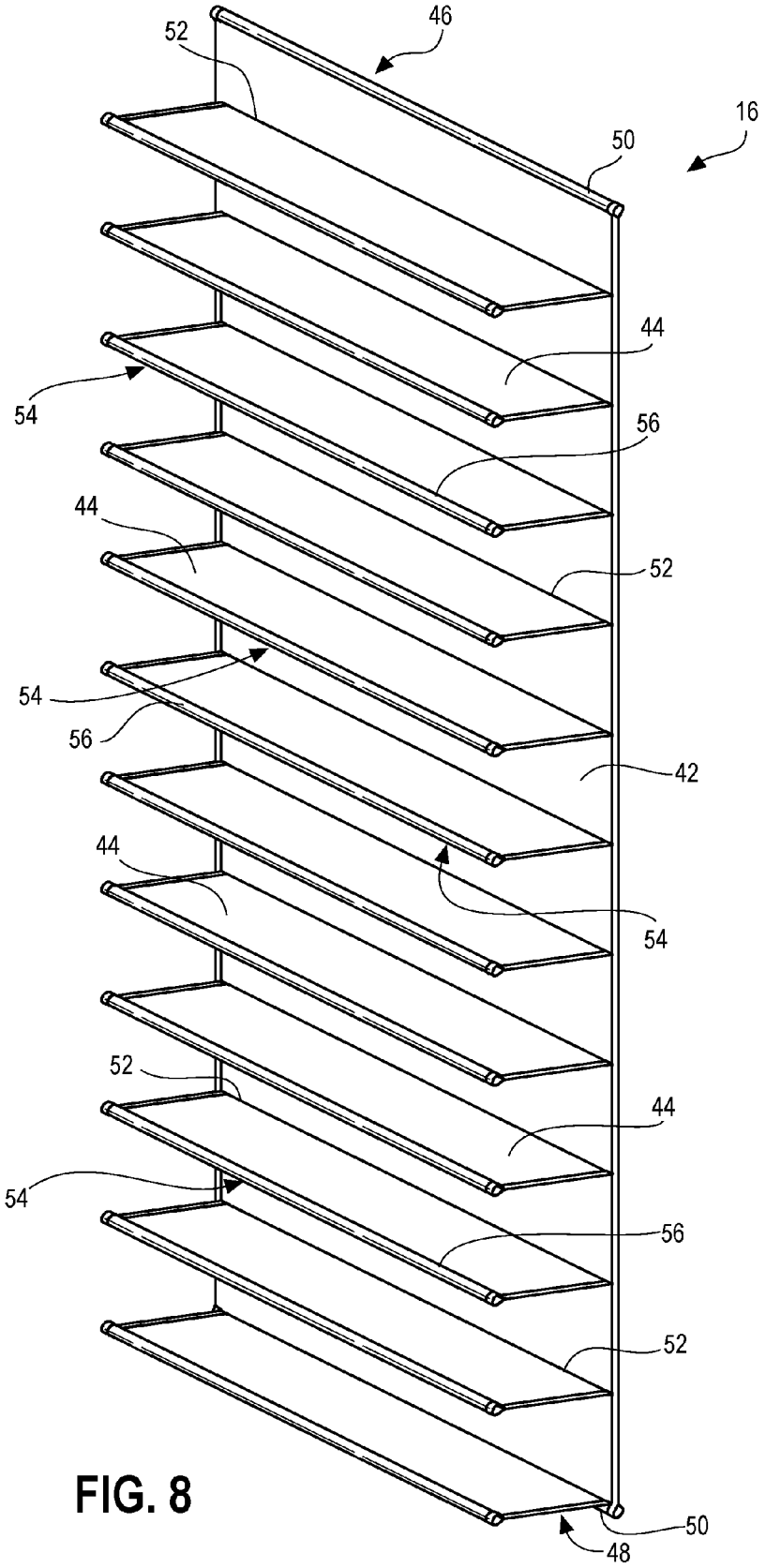
FIG. 8 is a perspective view of a liner portion of a storage unit in accordance with one embodiment of the present invention.
Figure 11:
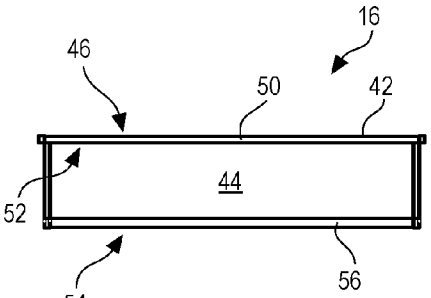
FIG. 11 is a top plan view of the liner portion of FIG. 8.
Figure 10:
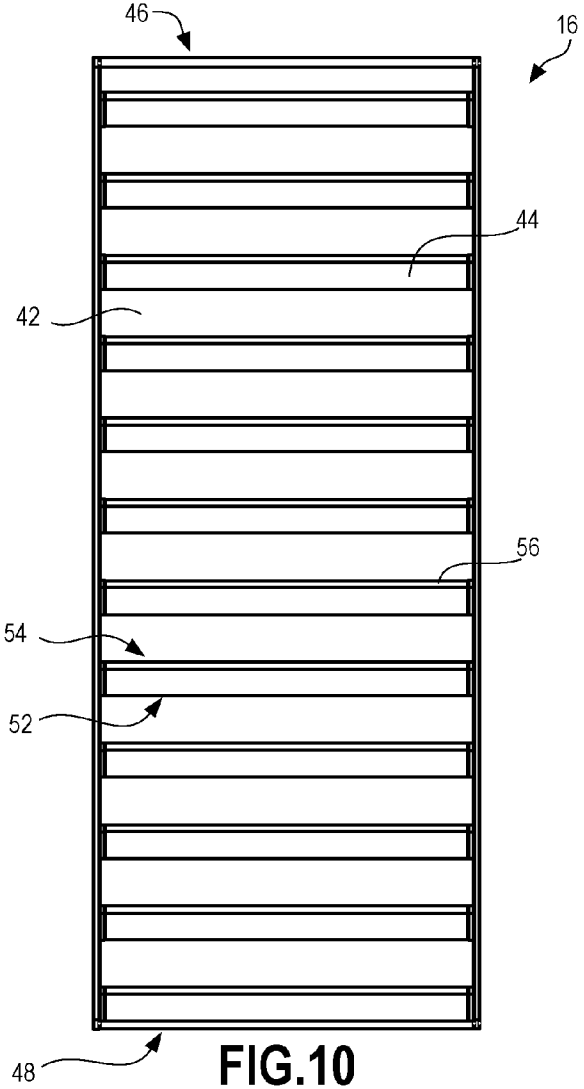
FIG. 10 is a front elevation view of the liner portion of FIG. 8.
Figure 9:
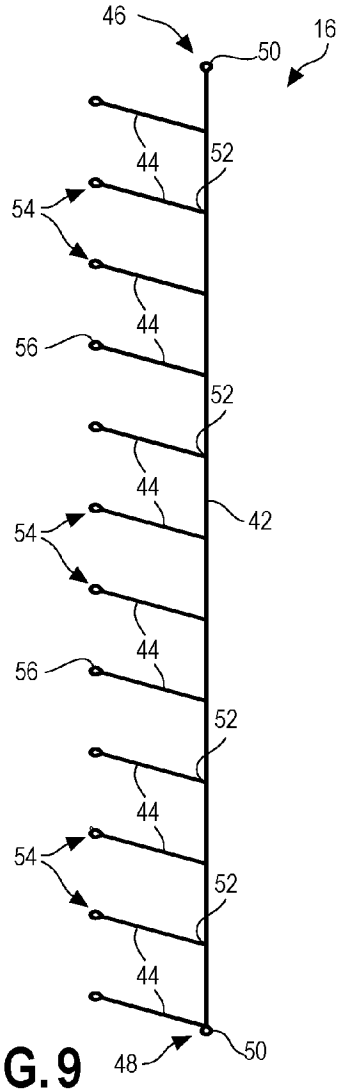
FIG. 9 is a side elevation view of the liner portion of FIG. 8.
Figure 13:
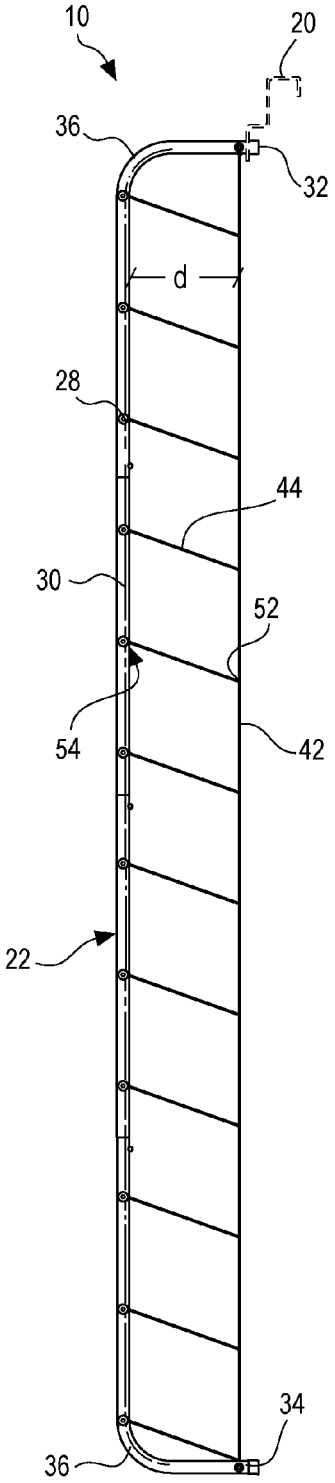
FIG. 13 is a side elevation view of the storage unit of FIG. 12.

As best shown in FIG. 8, backer portion 42 can include an upper end 46 and a lower end 48. Both ends 46 and 48 can be configured with loops, slots or other suitable receiving means 50 for receiving and/or otherwise securing liner portion 16 to upper and lower end supports 38 of frame portion 14. As best shown in FIGS. 12-14, receiving means 50 can be configured as loops sized and shaped to allow end supports 38 to be inserted therethrough prior to connection of upper and lower end supports 38 to vertical supports 22. For example, loops 50 can have a cross-section generally conforming to the cross-section of end supports 38. Such loops 50 can be constructed by sewing, adhesive or molding or by placement of selectively detachable fasteners, such as hook-and-loop strips, or other suitable means. In alternative embodiments (not shown), receiving means 50 can be configured as clips, rings, clasps, clamps, individually-spaced loops, fasteners or any other suitable means.

As best shown in FIGS. 12 and 13, shelving components 44 can be positioned along the height of backer component 42. Each shelving component 44 can include a fixed end 52 that can be connected to backer component 42 and a free end 54 that can be configured for securement to one of the plurality of horizontal cross supports 24 of frame portion 14. Fixed end 52 can be connected or secured to backer component 42 by sewing, adhesive, hook-and-loop fastener strips or other suitable means. Free end 54 can include a loop, slot or other suitable receiving means 56 for securing free end 54 to a horizontal cross support 24. According to the embodiment shown in the figures, receiving means 56 are constructed as sewn loops and configured for receiving horizontal cross support 24 before horizontal cross support 24 is connected to vertical supports 22 of frame portion 14. In such an embodiment, the cross-section of loops 50 can be generally similar or slightly larger than the cross-section of horizontal cross supports 24. In alternative embodiments (not shown), receiving means 56 can be configured as any other suitable means for attaching free end 54 to horizontal cross support 24 in a manner similar to receiving means 50 described above.

As best shown in FIGS. 12 and 13, shelving components 44 can be configured to have an angled orientation when liner portion 16 is connected to frame portion 14. The angled orientation can be created by selective positioning of fixed end 52 of each shelving component 44 along the height of backer component 42. As best illustrated in FIGS. 12 and 13, each fixed end 54 of each shelving component 44 can be fixed or secured to backer component 42 at an elevation slightly below the elevation of the corresponding horizontal cross support 24 when frame portion 14 and liner portion 16 are connected together. This differential-elevation configuration between fixed end 52 and free end 56 relative to horizontal cross supports 24 of frame portion 14 and backer component 42 of liner portion 16 can create the angled orientation of shelving components 44.

Turning now to FIG. 14, the construction of storage unit 10 according to one embodiment of the present invention is shown in greater detail. As shown, each horizontal cross support 24 can be inserted through (or otherwise secured to) the receiving means 56 of free end 54 of each corresponding shelving component 44. Similarly, upper and lower end supports 38 of frame portion 14 can be inserted through receiving means 50 of the upper and lower ends 46 and 48, respectively, of liner portion 16. The horizontal cross support ends 26, and the upper and lower end support ends 40, can then be secured to vertical supports 22 of frame portion 14 via connecting means 28. After all horizontal cross supports 24 and end supports 38 are secured between vertical supports 22, frame portion 14 and liner portion 16 will be secured together. As best shown in FIGS. 12 and 13 and described above, the shape of vertical supports 22 creates a space with depth d between backer component 42 and intermediate sections 30 of frame portion 12. Shelving components 44, secured to both horizontal cross supports 24 and backer component 42, can span through this created space in order to define the plurality of shelves 18 along the height of storage unit 10. Mounting brackets 20 can then be secured to frame portion 14, such as at upper ends 32 of each vertical support 22, in order to allow storage unit 10 to hang from or otherwise be mounted to any desired structure 12.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A storage unit configured for mounting to a vertically-orientated structure, said storage unit comprising:

a frame portion, said frame portion comprising:

at least one vertical support, said vertical support having an upper end and a lower end and an intermediate section positioned a first depth away from said upper end; and at least one generally horizontal cross support connected to and extending laterally from said at least one vertical support; and a liner portion configured for attachment to said frame portion comprising:

a backer component, said backer component configured for placement behind said intermediate section by a depth substantially equal to said first depth; and at least one shelving component connected to said backer component and sized to extend between said backer component and said at least one generally horizontal cross support, wherein said shelving component includes a fixed end secured to said backer component and a free end opposite said fixed end, said free end having a receiving means for receiving said at least one generally horizontal cross support, wherein said receiving means comprises a loop generally sized to accommodate a cross-sectional shape of said at least one generally horizontal cross support, wherein said at least one shelving component of said liner portion extends from said backer component to said at least one generally horizontal cross support with an angled configuration, wherein said liner portion and said frame portion collectively form at least one shelf adjacent to said at least one horizontal cross support, wherein said at least one shelf has a depth substantially equal to said first depth.

2. The storage unit of claim 1, wherein said angled orientation of said at least one shelving component is sloped toward said backer component.

3. The storage unit of claim 1, wherein said fixed end of said at least one shelving component is secured to said backer component at a first height of said storage unit and said at least one generally horizontal cross support is connected to said vertical support at a second height of said storage unit, wherein said first height is at an elevation less than an elevation of said second height.

4. The storage unit of claim 1, wherein said at least one vertical support includes an inward bent section extending between said intermediate section and said upper end and between said intermediate section and said lower end.

5. The storage unit of claim 4, wherein said frame portion includes an upper generally horizontal end support extending generally laterally away from said upper end and a lower generally horizontal end support extending generally laterally away from said lower end.

6. The storage unit of claim 5, wherein said at least one vertical support comprises a first vertical support and a second vertical support, wherein said at least one generally horizontal cross support extends laterally between said first vertical support and said second vertical support, wherein said upper end support extends between said upper ends of said first and said second vertical supports, wherein said lower end support extends between said lower ends of said first and said second vertical supports.

7. The storage unit of claim 6, wherein said at least one generally horizontal cross support comprises a plurality of generally horizontal cross supports spaced along a height of said first and said second vertical supports, wherein each generally horizontal cross support includes a first end connected to said first vertical support and a second end connected to said second vertical support.

8. The storage unit of claim 7, wherein said liner portion comprises:

a backer component having an upper end configured for connection to said upper end support and a lower end configured for connection to said lower end support, wherein said backer component is located a depth behind said intermediate sections of said first and said second vertical supports substantially equal to said first depth; and a plurality of shelving components spaced along said height of said first and said second vertical supports, wherein each shelving component of said plurality of shelving components includes a first end fixed to said backer component at a first height and a second end configured for connection to a corresponding generally horizontal cross support from said plurality of generally horizontal cross supports of said frame portion.

9. The storage unit of said claim 8, wherein said corresponding generally horizontal cross support is connected to said first and said second vertical supports at a second height, wherein said second height is greater than said first height.

10. The storage unit of claim 9, wherein said second end of each of said shelving components includes a receiving means for receiving said corresponding generally horizontal cross support.

11. The storage unit of claim 1, wherein said frame portion is constructed from hollow metal tubes.

12. The storage unit of claim 1, wherein said liner portion is constructed from a fabric material.

13. A storage unit for storing shoes and configured for mounting to a door, said storage unit comprising:

a frame portion comprising:

first and second vertical supports spaced laterally apart from one another, wherein each of said first and said second vertical supports includes an upper end, a lower end, and an intermediate section displaced outward from said upper and said lower ends;

a plurality of generally horizontal cross supports extending between said intermediate sections of said first and said second vertical supports, wherein said plurality of generally horizontal cross supports are spaced apart along a height of said storage unit;

an upper end support extending between said upper ends of said first and said second vertical supports; and a lower end support extending between said lower ends of said first and said second vertical supports; and a liner portion comprising:

a backer component extending said height of said storage unit, said backer component including an upper end having a receiving means for receiving said upper end support of said frame portion and a lower end having receiving means for receiving said lower end support of said frame portion; and a plurality of shelving components connected to said backer component, wherein each shelving component of said plurality of shelving components includes a fixed end connected to said backer component at a first height and a free end having receiving means configured for receiving a corresponding generally horizontal cross support of said plurality of generally horizontal cross supports;

wherein said corresponding generally horizontal cross support is connected to said first and said second vertical sections at a second height;

wherein said second height is greater than said first height so that said shelving components extend from said backer component to said generally horizontal cross supports with an angled orientation.

14. The storage unit of claim 13, wherein said frame portion includes at least one mounting bracket for hanging said storage unit over a door.

15. The storage unit of claim 13, wherein said frame portion is constructed from a plurality of hollow metal tubes and said liner portion is constructed from a fabric material.

* * * * *